US005646490A

United States Patent [19]

Carson et al.

[11] Patent Number: 5,646,490

[45] Date of Patent: Jul. 8, 1997

[54] PHASE INDEPENDENT SIGNALING FOR MULTIPLE CHANNEL, MULTIPLE SCENE DIMMING SYSTEM

[75] Inventors: Steven R. Carson, Lucas; Robert Anthony Floyd, Garland, both of Tex.

[73] Assignee: The Genlyte Group Incorporated, Secaucus, N.J.

[21] Appl. No.: 431,689

[22] Filed: Apr. 28, 1995

[51] Int. Cl.[6] ..... H05B 37/02

[52] U.S. Cl. ..... 315/317; 315/292; 315/318

[58] Field of Search ..... 315/301, 293, 315/292, 291, 316, 317, 312, 318

[56] References Cited

U.S. PATENT DOCUMENTS 4,158,132 6/1979 O'Dell ..... 250/205
4,511,824 4/1985 Goddard ..... 315/297

*Primary Examiner*—Robert Pascal
*Assistant Examiner*—David Vu
*Attorney, Agent, or Firm*—Dennis T. Griggs

[57] ABSTRACT

A lighting control and dimming system utilizes a single traveler conductor for transmitting analog data signals corresponding to a particular light intensity level of a dimmer group. A predetermined binary data word is retrieved from the read-only memory of a remote controller, and is transmitted serially in an analog pulse train over the traveler conductor to each dimmer unit. Each dimmer unit includes a microcontroller and read-only memory in which a group of binary numbers are stored. The analog data signal received by each dimmer is converted to binary and is compared bit-by-bit with each binary number stored in the dimmer memory. A serial bit comparator produces an enable signal in response to a bit-by-bit identity match between the converted analogy data signal and the preset binary number stored in the dimmer ROM. All the dimmers are enabled by the transmitted analog data signal, thus producing a predetermined scene at a particular brightness level corresponding with one of the stored binary numbers.

6 Claims, 7 Drawing Sheets

PHASE INDEPENDENT SIGNALING FOR MULTIPLE CHANNEL, MULTIPLE SCENE DIMMING SYSTEM

FIELD OF THE INVENTION

This invention relates generally to lighting controllers, and in particular to light dimming systems.

BACKGROUND OF THE INVENTION

Light dimming systems are used to control multiple lighting circuits which may be widely separated from each other by a substantial distance, for example in a restaurant, a large meeting hall or in a theater. The lighting circuits are connected to power dimmers so that the intensity of the lights can be controlled collectively, individually or in groups whereby a variety of different combinations of lighting levels may be selected for achieving different lighting effects (scenes).

Typically, each light or group of lights is selectively controlled through a power dimmer, which is in turn connected to an individual controller or operator switch. In such a system, separate sets of wires run from a central controller to each light or group of lights. Sometimes, dimmers are included along with wall-mounted toggle switches for controlling the level of power supplied to each of the lighting circuits. Such dimmers usually take the form of rheostats which are manually set to the desired level of brightness. Consequently, even for small installations, a large amount of wiring is necessary to connect all of the lights with their respective power dimmers, and to connect the power dimmers to their respective controllers.

DESCRIPTION OF THE PRIOR ART

Conventional lighting control and dimming systems provide a main switch control station and one or more remote dimming stations which provide independent ON/OFF operation and dimming control. Such systems utilize three-way and four-way dimmer switches in combination with one or more traveler wires to provide independent ON/OFF dimming operation at each remote location. In a typical installation in which a single overhead light is controlled and dimmed from a main station and a remote station, a manual, two-way dimmer switch is installed in a wall box at the main switch station, and a manual, two-way dimmer switch is installed in a wall box at the remote switch station. One side of the lamp load is connected to the power source neutral conductor and the other side of the lamp load is connected by a load conductor to the main station switch. A hot conductor connects the hot supply line to the remote dimmer switch. The main dimmer switch and remote dimmer switch are further interconnected by an auxiliary power distribution conductor, commonly referred to as a traveler conductor, a hot line conductor and a ground safety conductor. In this two-way switching and dimming arrangement, the lamp load is wired in the conventional "switched hot" configuration.

Some remote dimmer switches have been connected to a master dimmer controller in such installations, but have required two or more additional conductors and a remote power supply for providing logic high and logic low control signals to the master switch control circuit when the lighting load is turned on. In a retrofit installation in which the main power switch and remote switch are to be replaced, it is desirable to remove the switches at each switch station and install a main dimmer controller in the main station wall box and a remote dimmer in each remote station wall box. Moreover, it is desirable to connect the remote dimmer switches to the main dimmer switch control circuit by utilizing only the existing traveler conductor and ground safety conductor which interconnect the main and remote wall box switch stations. In new wiring installations, a single conductor (e.g. traveler conductor) interconnection of remote dimmer stations with the master dimming controller is also desirable for the purpose of simplifying the wiring interconnections and for reducing wiring installation costs.

In domestic and commercial installations, two-phase power is supplied, with phase A power being applied to one group of electrical loads, and phase B power being applied to another load group. Consequently, in a large area lighting installation, some of the lighting loads will be supplied by phase A power, and other lighting loads will be supplied by phase B power. Such dimming systems typically utilize semiconductor switching devices whose duty cycle is controlled with reference to the phase of the current waveform. Because of the phase difference, it is difficult to utilize conventional light dimming systems which employ a microprocessor controlled memory unit for selectively controlling the application of power to a specific group of lighting loads which may be separately energized by phase A and phase B power.

OBJECTS OF THE INVENTION

It is a general object of the present invention to provide a light dimming system in which the amount of wiring used to connect a controller to multiple power dimmers is substantially reduced.

Another object of the present invention is to provide a lighting control and dimming system having a single conductor to which several individually-dimming lighting loads can be controlled without appreciably increasing the amount of wiring.

Another object of the present invention is to provide an improved light dimming system in which multiple scenes can be stored and selected manually at a master control station and at each dimmer station.

Yet another object of the present invention is to provide a lighting control and dimming system which can send and receive dimmer station address signals from a remote controller or a master controller independently of line phase per dimmer station or controller station.

SUMMARY OF THE INVENTION

The foregoing objects are achieved by a lighting control and dimming system which utilizes a single conductor, for example the traveler conductor, for transmitting analog data signals to each dimmer of the light/dimmer group. The master controller includes a signal generator for generating a unique and predetermined analog data signal corresponding to a predetermined lighting intensity level for a particular scene. The predetermined analog data signals are stored within a read-only memory of a microcontroller in the master controller and are transmitted serially over the traveler conductor to each dimmer unit. Each dimmer unit includes a microcontroller and read-only memory in which corresponding binary numbers are stored.

In response to operator selection of a predetermine scene, the microcontroller selects from memory the corresponding binary data signal and transmits it serially as an analog data signal over the traveler conductor to an input shift register in each dimmer. The data content of the input shift register is compared, bit-by-bit, with the binary number stored in the dimmer ROM. A serial bit comparator produces an enable signal in response to a bit-by-bit identity match between the transmitted analog data signal and the binary preset number stored in the dimmer ROM. Only a match between the transmitted analog data signal and the binary number stored in the ROM will produce a predetermined scene. After being enabled, the dimmer can be manually adjusted to a new intensity setting, as desired.

The remote signalling and selection of a specific scene is made independently of phase by sampling the logic value of the remote input analog data signal immediately following a logic 1 to logic 0 transition of a zero cross signal. If the high to low transition occurs at any time during which the zero crossing signal is low, logic 1 is loaded into each dimmer remote input shift register. If no high-to-low transition occurs during that period, that particular bit of the remote input shift register is cleared to logic 0. Each time the zero crossing signal returns to logic high, the contents of each dimmer remote input register are shifted, and the contents of each input register are compared bit-by-bit to the contents of the binary number which is stored in the read-only memory of each dimmer microcontroller. A particular dimmer is enabled in response to a match between the analog remote signal and the binary number stored in the dimmer memory.

Operational features and advantages of the present invention will be understood upon consideration of the following detailed description of the invention taken with reference to the accompanying drawings.

DETAILED DESCRIPTION OF THE PREFERRED EMBODIMENT

Figure 1:
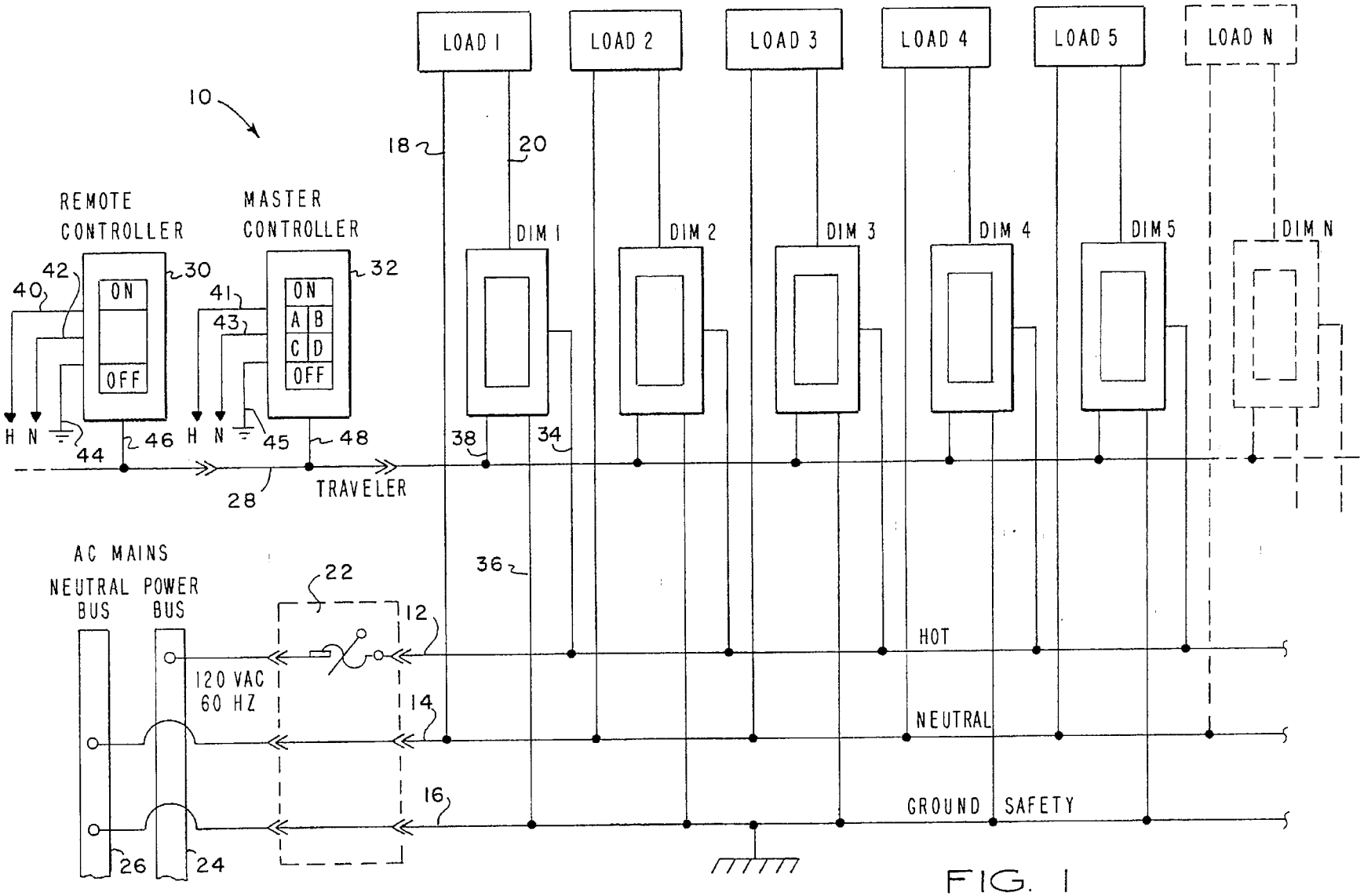
FIG. 1 is a block schematic diagram of a multi-channel, multiple scene lighting and dimming circuit.

Referring now to FIG. 1, the lighting control system. 10 of the present invention will be described with reference to the hot, neutral and ground safety power conductors 12, 14 and 16., respectively, of a 120 VAC, 60 Hz single phase AC power source which supplies operating power to multiple lighting loads LOAD 1, LOAD 2, . . . , LOAD N. According to conventional AC wiring practice, one terminal of a lighting load, for example LOAD 1, is connected to the neutral supply conductor 14 by a load conductor 18, and the other terminal of LOAD 1 is connected to the switched terminal of a dimmer switch DIM 1 by a load conductor 20. Preferably, the dimmer switch DIM 1 is a programmable dimmer as described and claimed in U.S. Pat. No. 4,733,138 which assigned to the assignee of the present invention, and is incorporated herein by reference.

Operating power is conducted through a thermal circuit breaker 22 which connects the conductor 12 and an AC power bus 24. Load current is returned through the neutral conductor 14 to a neutral bus 26. According to conventional practice, the ground safety conductor 16 is also electrically connected to the AC neutral bus and is extended in parallel with the hot conductor 12 along the distribution path for safety purposes. At least the hot conductor 12 and the ground safety conductor 16 will be available at each dimmer station. A traveler conductor 28 will be available in addition to the hot and ground safety conductors between the dimming stations.

The lighting control system of 10 includes a remote controller 30 and a master controller 32. The number of dimmer switches which may be coupled to the master controller 32 is limited to approximately 24 channels because of fan-out loading, since the dimmers draw operating current in the standby operating mode.

Figure 2:
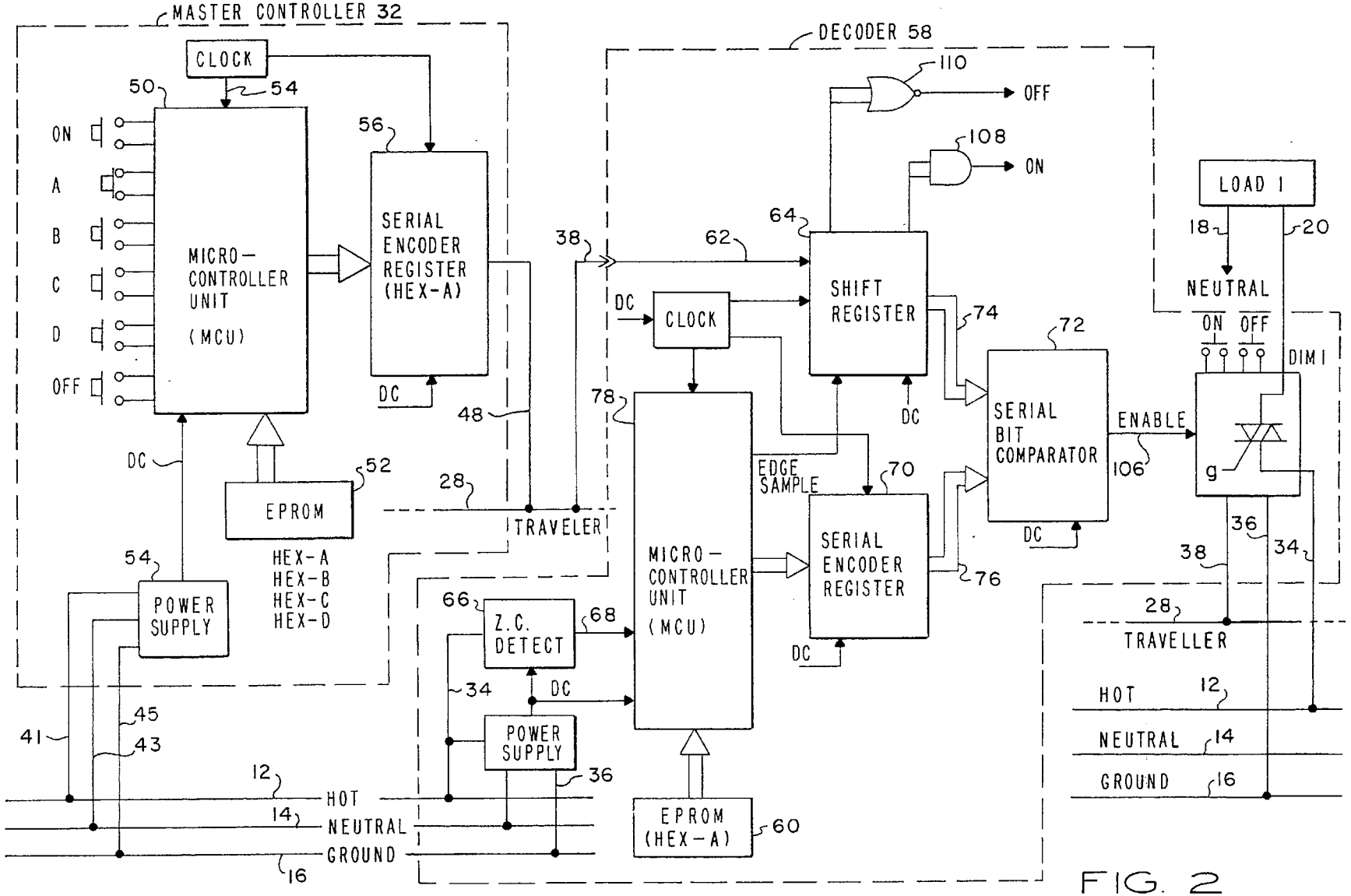
FIG. 2 is a block schematic diagram of the master controller shown in FIG. 1.

Referring now to FIG. 1 and FIG. 2, the dimmer switches DIM 1, DIM 2, . . . , DIM N have identical circuit construction. The dimmer switch DIM 1 has a first power input conductor 34 connected to the hot power conductor 12 and a second power input conductor 36 connected to the ground safety conductor 16. The dimmer switch DIM 1 also includes a signal output conductor 38 which is electrically connected to the traveler conductor 28 which leads from the remote controller 30 and master controller 32 to each dimmer unit. Likewise, the remote controller 30 includes input power conductors 40, 42, 44 electrically connected to the hot, neutral and ground conductors 12, 14, 16, respectively, and a signal output conductor 46 which is electrically connected to the traveler conductor 28. The traveler conductor 28 is electrically connected to the remote signal output node 48 of the master controller unit 32.

It will be appreciated that the dimmer switch stations DIM 1, DIM 2, DIM 3 . . . . , DIM N are widely separated with respect to each other, and with respect to the master controller 32. At each dimming station, at least the hot conductor 12, the ground safety conductor 16 and the traveler conductor 28 are available for interconnection.

Consequently, the dimmers, master controller and remote controller are wire-for-wire interchangeable with conventional two-way manual power switches. Each dimmer switch, the master controller and remote controller include manually operable, momentary contact switches designated ON and OFF, respectively. According to this arrangement, independent ON/OFF manual switch operation is provided at each controller and dimmer station.

Referring now to FIG. 2, construction of the remote controller 30 and the master controller 32 are identical. Each controller is capable of storing four scenes, corresponding with four separate intensity levels (A, B, C, D), and are connected in communication with each dimmer unit via the traveler conductor 28. Each controller includes a microcontroller 50, a read-only memory 52, a power supply 54 and a serial encoder register 56. These components are arranged in the form of an information storage and retrieval system making possible the ability to store a predetermined number of scenes and to perform all the necessary control functions. The microcontroller 50 may be any one of several conventional microcontrollers which are commercially available.

The type of microcontroller used is largely dependent upon the capacity desired, and is designed so that a variety of logical and arithmetic operations may be performed on or between two accumulation registers including additions, subtractions, logical AND'S, OR'S, compares, compliments, tests and shifts. Dedicated registers (not shown) are used in the control of the system, and include a program counter, an index register, a stack pointer and a condition code register. These are generally controlled by the microcontroller logic, although they may be used or altered under program control.

The microcontroller 50 includes a read-only memory 52 which includes an operating program. The operating program allows user programs and data to be stored in the read-only memory, the working registers to be examined and the execution of the user program to be supervised. Preferably, the read-only memory 52 is an electrically programmable read-only memory (EPROM).

The microcontroller 50 includes an ON switch, an OFF switch and four pre-set scene switches labeled A, B, C and D. All of these switches are single pole, single throw, non-latching push-button switches. The depression of each of the switches connects a grounds reference voltage available from a local power supply and provides the microcontroller 50 with a logical "zero" input. The microcontroller 50 recognizes the logical zero as a signal that the switch has been depressed. Other configurations of the switches are possible, being important only that the switch have an operative and a non-operative position in order to provide logic signals to the microcontroller. The ON switch provides a fade "up" function when it is depressed and held. Likewise, the OFF switch provides a fade "down" switch which is operative when, it is depressed and held in the closed position. The switches A, B, C and D correspond with four predetermined hexadecimal numbers, HEX-A, HEX-B, HEX-C and HEX-D which are stored in the read-only memory 52.

Figure 9:
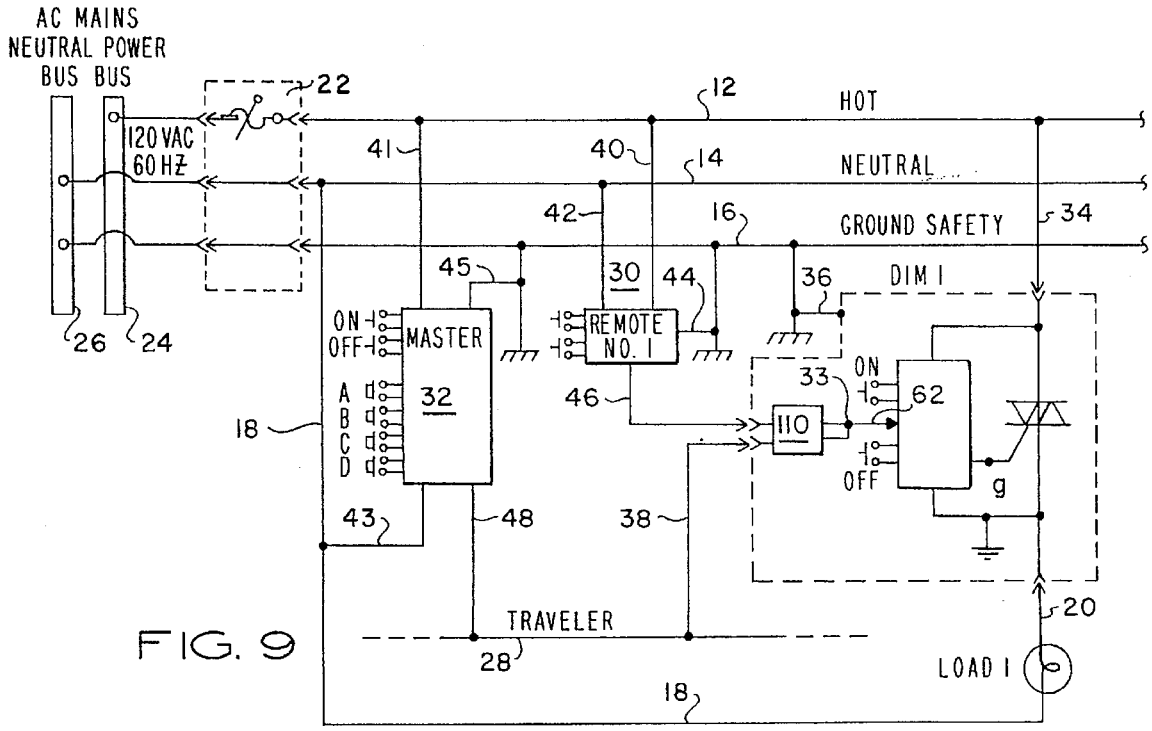
FIG. 9 is a block schematic diagram of a lighting and dimming circuit which includes local and network remote controllers; and, FIG. 10 is the low pass attenuator circuit shown in FIG. 9.

The operating program of the microcontroller 50 addresses the various input switches and determines the status of each switch. When a preset switch is depressed, its status is logic low, and the operating program of the microcontroller issues a command which retrieves the corresponding HEX-coded signal frown the read-only memory and inputs the HEX-coded signal to the serial encoder register 56. In the example shown in FIG. 1, preset switch A is depressed, with HEX signal HEX-A being retrieved and input into the serial encoder register 56. The analog data signal corresponding with HEX-A is transmitted to the traveler conductor 28 through an output conductor 48 (FIG. 2, FIG. 9).

In the output mode, a communications interface transfers the coded signal HEX-A over an internal bus to the serial encoder register 56 according to an external clock signal 54. Condition codes determine the transmitting rate, and the number of start, stop and parity bits required. The complete analog data word HEX-A is shifted out of the serial encoder register 56 through the output conductor 48 at the given clock rate.

Each dimming unit includes a decoder 58 for receiving, decoding and comparing the remote analog signal HEX-A and comparing it with a predetermined HEX coded number in a read-only memory 60. The encoded analog signal HEX-A is input from the traveler conductor 28 through an input conductor 62 to a shift register 64.

Figure 5:
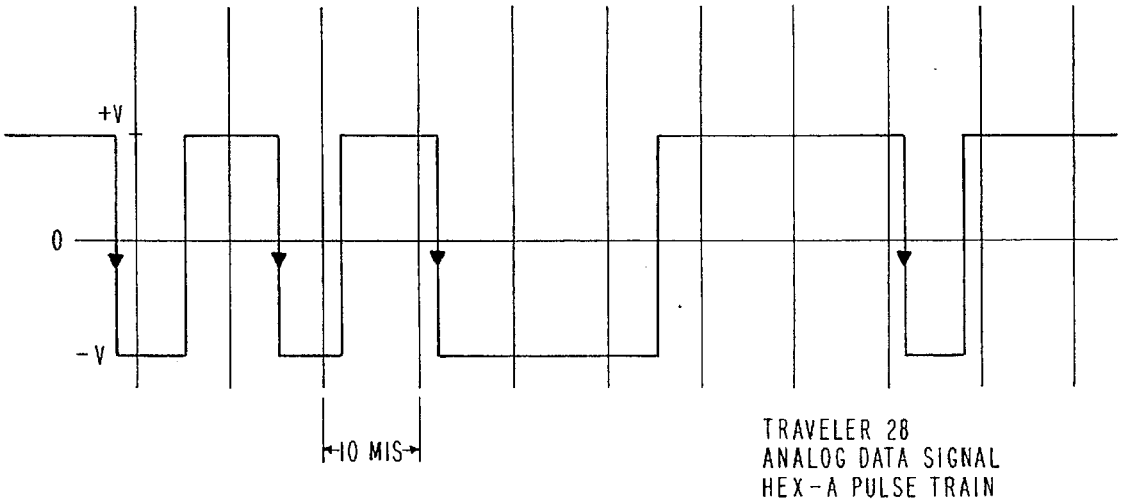
FIG. 5 is a waveform diagram of the analog data signal corresponding with a HEX-A pulse train.
Figure 6:
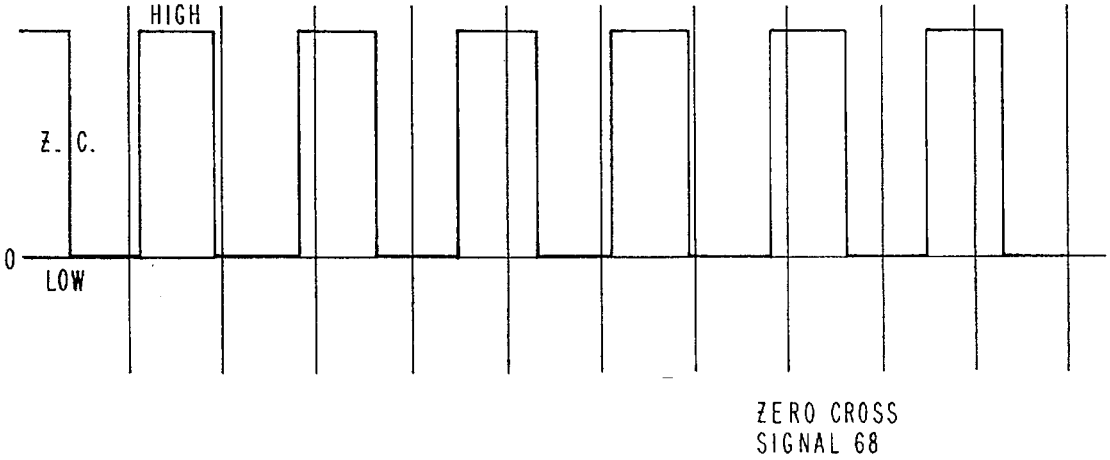
FIG. 6 is a waveform diagram of the zero cross signal appearing on the output of the zero cross detector.

Referring now to FIG. 2, FIG. 5 and FIG. 6, the remote signalling and selection of each dimmer having a number corresponding to the analog signal stored in the EPROM memory 60 is made independently of phase by sampling the logic value of the remote input signal immediately following a logic 1 to logic zero transition of a zero cross signal. For this purpose, a zero cross detector 66 produces a zero cross signal 68 which is derived from zero cross transitions of the line voltage on the hot conductor 12. If the high-to-low transition occurs at any time during which the zero crossing signal is low, the least significant bit of the dimmer input register is set to logic "1". If no high-to-low transition occurs during that period, that particular bit of the dimmer input register is cleared to logic "0". Each time the zero crossing signal returns to logic high, the contents of the dimmer input register are shifted. After shifting, the contents of each input register dimmer are compared bit-by-bit to the HEX-coded number which is stored in the read-only memory 60 of the dimmer microcontroller 78. Each dimmer is enabled in response to a bit-by-bit match between the analog remote signal and the HEX-coded number stored in each dimmer memory.

Figure 4:
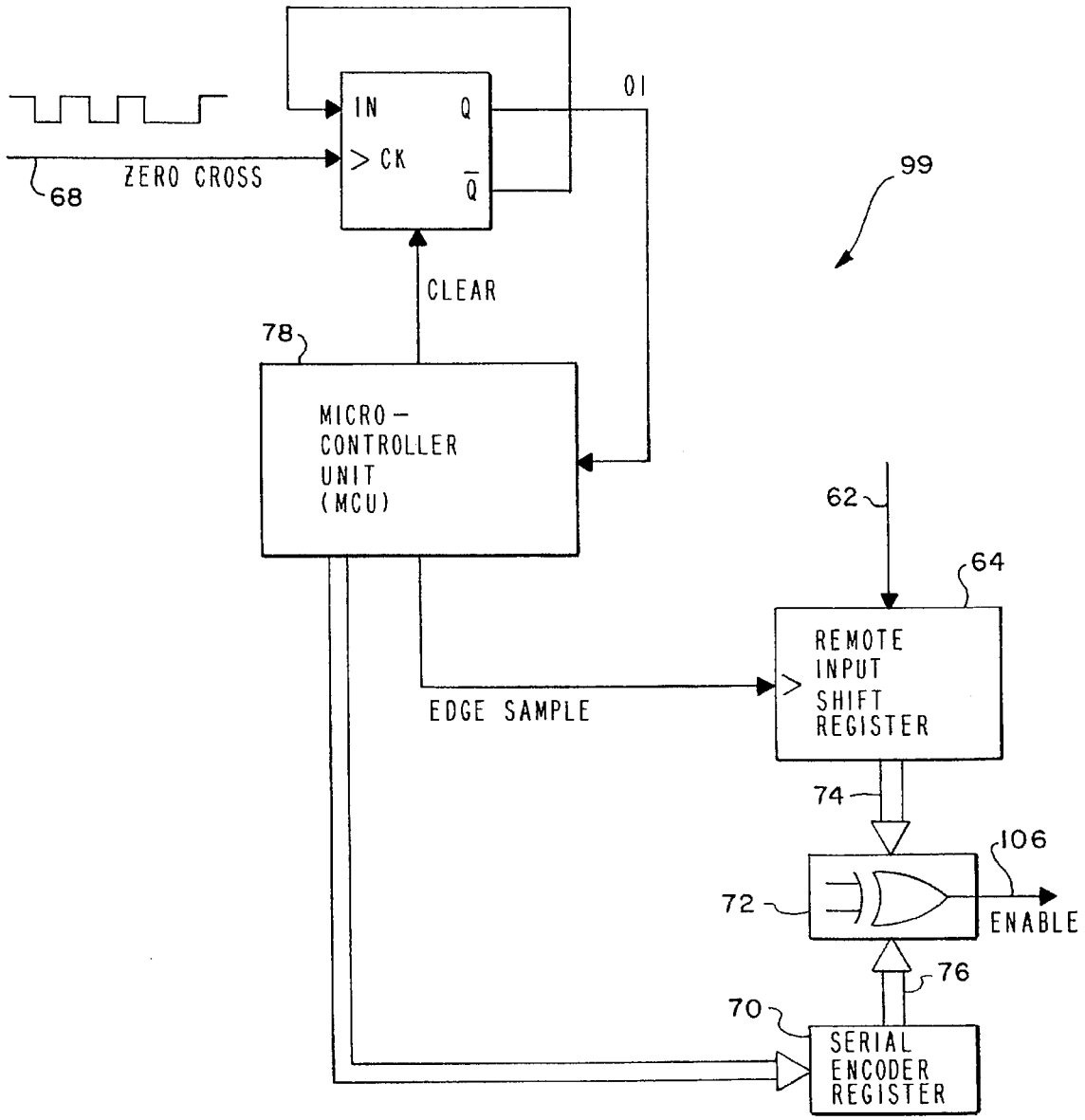
FIG. 4 is a simplified schematic block diagram of an edged detector circuit.

Referring now to FIG. 4, FIG. 5 and FIG. 6, in response to a high-to-low transition of the zero cross signal 68, the operating program of the microcontroller retrieves the binary number (HEX-A) stored in the read-only memory 60 and inputs it to a serial encoder register 70. Each time the zero crossing signal returns to logic high, the contents of the dimmer shift register 64 and the serial encoder register 70 are shifted by the output of an edge detector circuit 99 as shown in FIG. 4. The bit contents of each register are conducted to a serial bit comparator 72 through output buses 74, 76, respectively.

Figure 3:
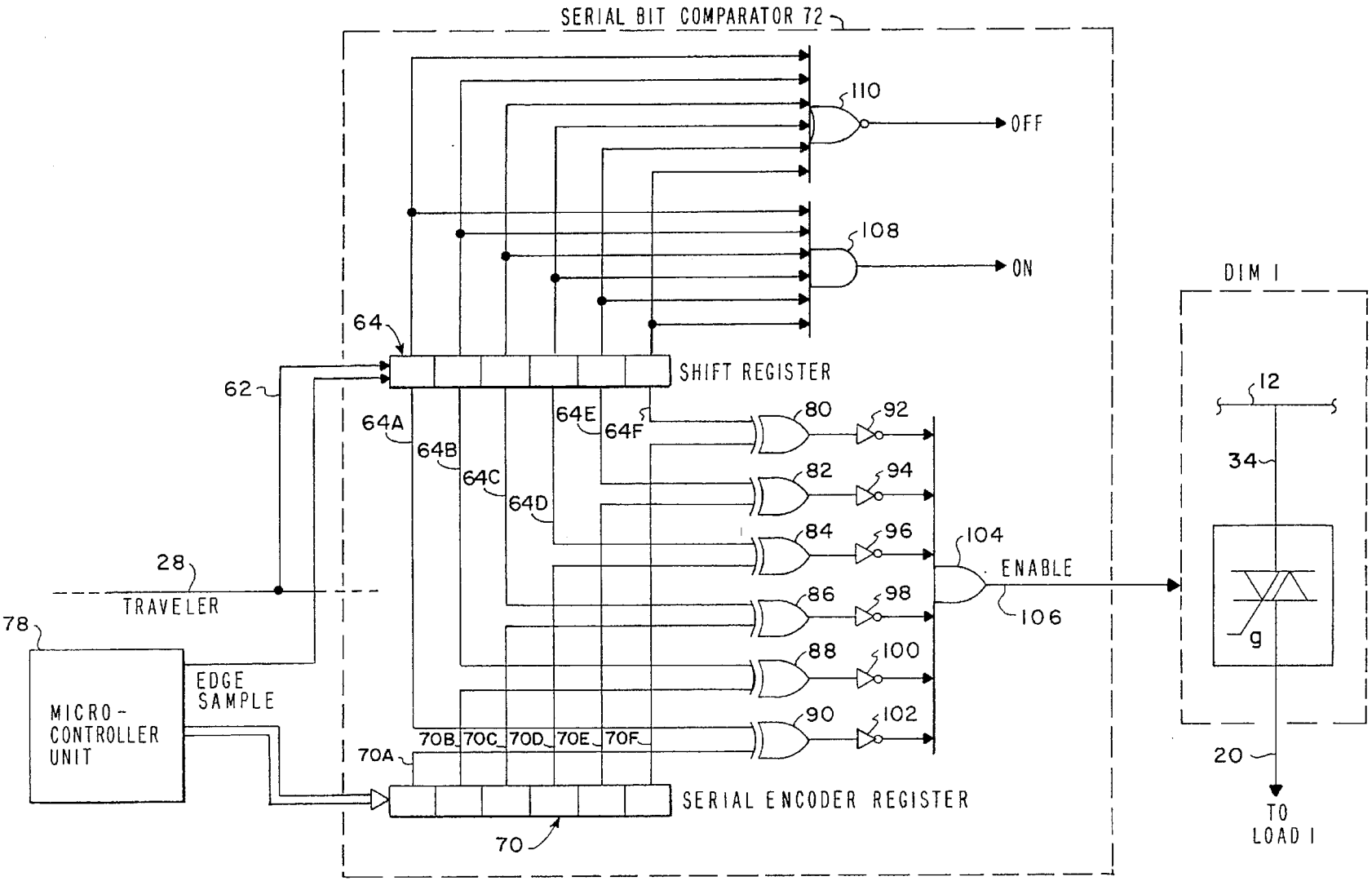
FIG. 3 is a simplified circuit diagram of the serial bit comparator of FIG. 2.

Referring now to FIG. 3, the shift register 64 and the serial encoder register 70 are six bit shift registers which are designed to hold the bits of the HEX encoded data word transmitted over the traveler conductor 28. In the present example, where the HEX encoded data word contains six bits of information, the encoded analog signal 62 is fed one bit at a time into the shift register 64 until all six bits are contained in the register and are simultaneously conducted over the corresponding six output lines 64A, 64B, 64C, 64D, 64E and 64F. Likewise, the binary number HEX-A, which was previously stored in the read-only memory 60, is retrieved by a microcontroller 78 and is fed one bit at a time into the serial encoder register 70 until all six bits are contained in the register. The logic value of each bit stored in the serial encoder register 70 is conducted over output lines 70A, 70B, 70C, 70D, 70E and 70F.

Corresponding bits 64F and 70F are simultaneously applied to the inputs of an exclusive OR (EXOR) gate 80 for comparison. Likewise, the corresponding bit pairs of the remaining bits of each register are input to exclusive OR (EXOR) gates 82, 84, 86, 88 and 90, respectively, for comparison of each bit pair. According to the logic of an exclusive OR gate, a logic zero on both inputs yields a logic zero and a logic one on both inputs yields a logic zero. If there is a logic match between corresponding bits, the output of the exclusive OR gate will be logic zero. Consequently, when there is an identical match between the remote analog data word (HEX-A) and the binary number (HEX-A) stored in the read-only memory 60, the output of each EXOR gate is logic zero.

The output of each EXOR gate is inverted by inverters 92, 94, 96, 98, 100 and 102, respectively. The inverted outputs are input to an AND gate 104 which provides a logic one enable signal 106 when each of its inputs is at logic one value. This will occur only when there is an exact match between the encoded remote signal (HEX-A) and the binary bits stored in the read-only memory 60 (HEX-A). Under this condition, the output of each EXOR gate is logic zero, and each inverted output is logic one. In response to that condition, the AND gate 104 produces a logic one signal on the output conductor 106, and is logic zero under all other input conditions.

Referring to FIG. 3, the ON function and the OFF function are generated in response to all data bits of the shift register 64 being at logic one value (ON function), or all data bits are logic zero (OFF function). The output of each data bit is input to an AND gate 108 which produces the ON signal in response to each input being at logic one value. Likewise, the bit contents are input to a NOR gate 110. According to the logic function of a NOR gate, a logic high output is produced in response to each input being at logic zero value. By this arrangement, the OFF signal is produced when each bit of the shift register 64 is at logic zero.

Accordingly, it will be seen that each dimmer unit can be loaded with unique encoded numbers which correspond to the encoded numbers stored in the read-only memory 52 of a remote controller or the main controller 32 in order to obtain a particular dimming level on the dimmer output. When an input switch (ON, A, B, C, D, OFF) is depressed, encoded analog signals are conducted over the traveler conductor 28 as a serial stream of analog pulses which are applied to the shift register 64 input of each dimmer unit. In this manner, each dimmer unit is enabled by the operator depressing one of the selector switches.

The master controller 32 will select any scene, fade to "full" or "off" and raise/lower all dimmers together, without losing the scene or preset memories. The remote controller will select only the ON scene, OFF and raise/lower all channels together. For selection of a specific scene, the desired switch ON, A, B, C, D is depressed in the master controller. The current scene switch includes a light emitting diode (LED) which will glow to indicate scene status. To raise all dimmer channels together, the ON scene switch is pressed and held until the lights reach the desired intensity. When all channels are raised or lowered together, the system is in the ON condition, although each dimmer is not necessarily at its preset ON level and may, in fact, be at a lower intensity.

Figure 7:
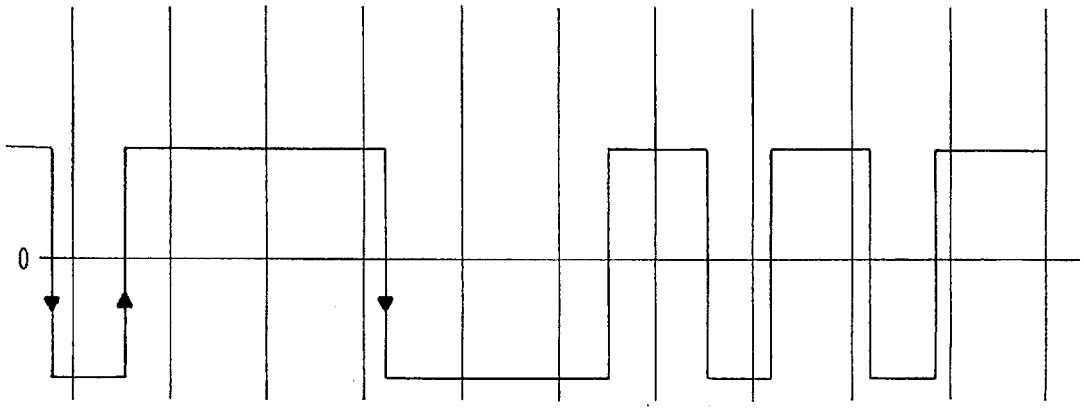
FIG. 7 and FIG. 8 are waveform diagrams corresponding with FIG. 5 and FIG. 6, which illustrate an alternative high-to-low transition detection method.
Figure 8:
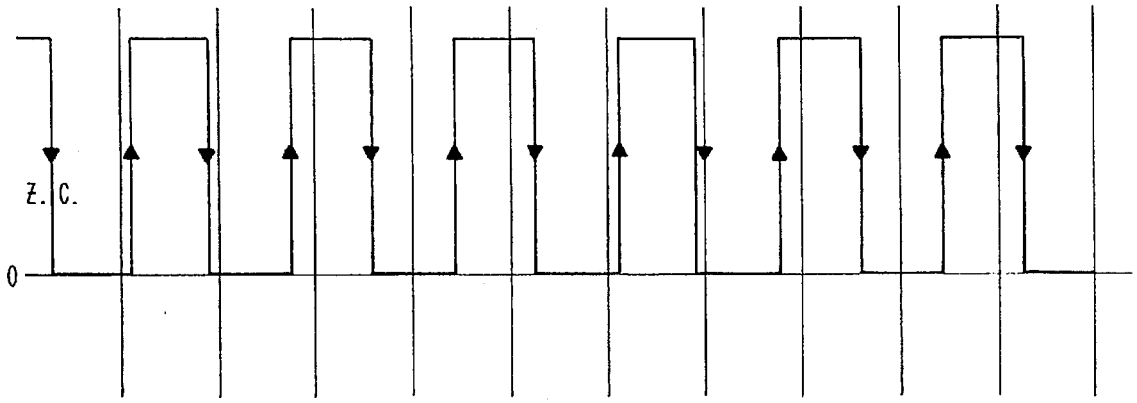

Referring now to FIG. 7 and FIG. 8, in an alternative embodiment, the microcontroller 78 of each dimmer unit includes another subroutine that performs exactly as stated above except that it waits for the zero crossing to go high before checking the remote input of the micrcontroller. This was done in case the first routine is not able to decode the remote pulse train correctly, thereby assuming reliable operation.

According to an alternative method for decoding the four remote signals (A, B, C, D), each time a zero crossing signal makes a high to low transition, the remote input to the microcontroller is sampled to obtain the logic level. If the remote input is high, then the least significant bit for the REMOTE INPUT register is set to logic "1". If the remote input is low when the zero crossing makes its high to low transition, then the LSB of the register is cleared to a "0". After setting or clearing this bit, the register contents are shifted left and an exclusive OR operation is performed between REMOTE INPUT register #1, and REMOTE INPUT register #2. The result of the exclusive 0R operation is then compared with the four binary numbers for the four dimmer scenes. If there is a match, then the dimmer has successfully decoded a remote signal.

In a separate memory register, which will be called REMOTE INPUT register #2, the status of the remote input for the microcontroller is stored based upon a low to high transition of the zero crossing signal. For example, when the zero crossing signal changes from a low logic level to a high logic level, the remote input to the micrcontroller is read to check its logic level. If it is high, then the least significant bit of REMOTE INPUT register #2 is set to a "1". If it is low, then the LSB of the remote input register #2 is cleared to a zero. After setting or clearing this bit, the register contents are shifted left.

Figure 10:
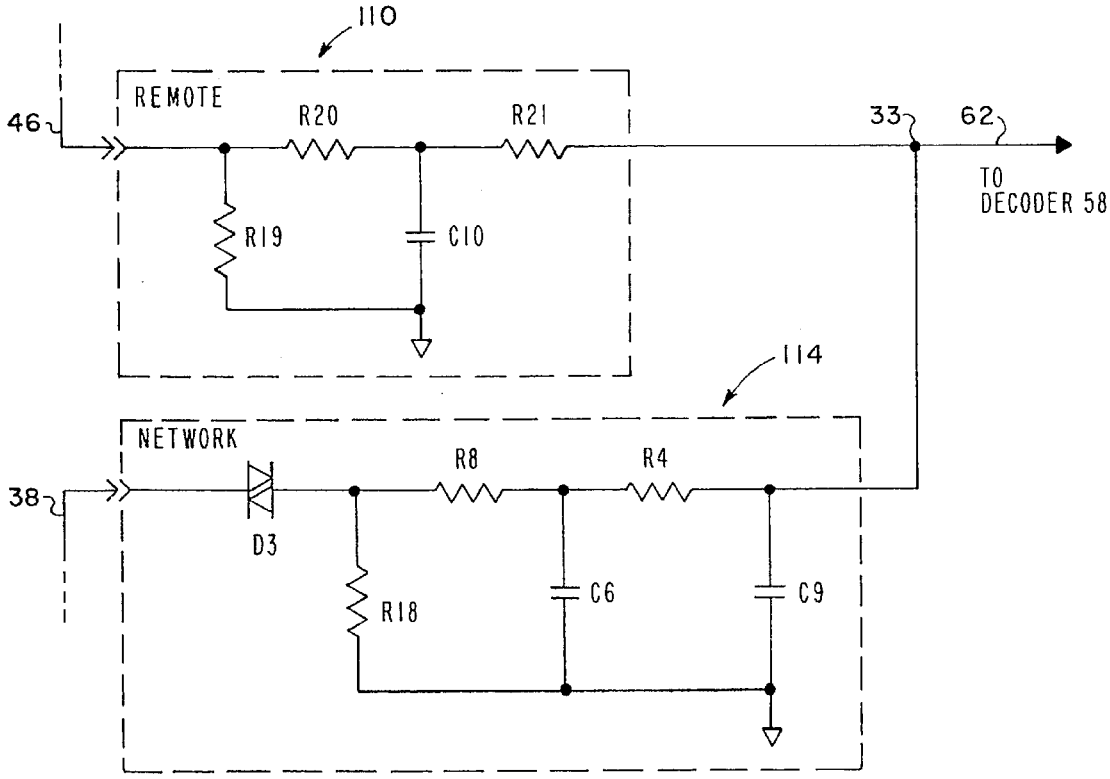

Referring now to FIG. 9 and FIG. 10, a low pass attenuator circuit 110 is interposed between the remote controllers and dimmer DIM 1. The attenuator circuit 110 permits a single remote controller, for example remote controller 30, to change a single dimming station, for example DIM 1, without affecting the intensity setting of any of the other dimmers which are connected to the network traveller conductor 28. Preferably, the attenuator circuit 110 provides signal attenuation in a ratio of about 20:1. The network traveller 28 is decoupled with respect to a dimming selection signal from controller 30 applied to the input terminal 33 of dimmer DIM 1 by a low pass filter 114 which is connected in series electrical circuit relation with a diac diode D3. The diac diode D3 presents a high impedance to the flow of current from the input node 33 through the network remote controller input terminal.

Although the present invention and its advantages have been described in detail, it should be understood that various changes, substitutions and alterations may be made herein without departing from the spirit and scope of the present invention as to find by the appended claims.

What is claimed is:

1. A system for selectively enabling one or more lighting levels of a dimmer group regardless of differing line phase comprising, in combination:

signal means for generating a unique and predetermined analog data signal corresponding to a predetermined lighting level (scene);

receiver means for translating said analog data signal into a binary data signal and comparing said binary data signal with a predetermined binary number;

means for detecting a bit-by-bit match between the binary data signal and the predetermined binary number; and means coupled to the comparator for producing an enable signal in response to a bit-by-bit match between the binary data signal and the predetermined binary number.

2. A system as defined in claim 1, including:

a common bus conductor for conducting the analog data signal from the signal generating means to the receiver means.

3. A system as defined in claim 1, wherein said signal generating means comprises a read-only memory for storing binary data signals, each binary data signal being representative of a particular lighting scene.

4. A system as defined in claim 1, wherein said signal generating means further comprises a register for holding a binary data signal retrieved from said memory means, and means for transferring said binary data signal from said register to the receiver means.

5. A system for controlling the light intensity level of a lighting group including one or more lights and one or more dimmers, said system comprising, in combination:

control means for generating an analog data signal corresponding to predetermined lighting level;

receiver means including register means for translating said analog data signal into a binary data signal, clocking means for clocking the binary data signal into the register means, comparative means for comparing the binary data signal with a predetermined binary number when said predetermined binary number is present in said register means, and means for generating an enable signal only when the binary sequence of the binary data signal matches the binary sequence of the predetermined binary number; and a common bus conductor for transmitting the analog data signal from the control means to the receiver means.

6. A method for controlling the light intensity level of a lighting group including one or more dimmers and one or more lighting loads coupled to said dimmers, said method comprising the steps of:

generating a predetermined analog data signal corresponding to a predetermined light intensity level of said lighting group;

transmitting said analog data signal from said signal generating means to the one or more dimmers over a common bus conductor;

translating the analog data signal into a binary data signal;

in each dimmer, comparing the binary data signal with a predetermined binary number stored in each dimmer; and, enabling each dimmer in which the comparing step produces a bit-by-bit match between the binary data signal and the stored binary number.

* * * * *